US007473849B2

(12) United States Patent
Glew

(10) Patent No.: US 7,473,849 B2
(45) Date of Patent: Jan. 6, 2009

(54) VARIABLE DIAMETER CONDUIT TUBES FOR HIGH PERFORMANCE, MULTI-MEDIA COMMUNICATION CABLE

(75) Inventor: Charles A. Glew, Pawcatuck, CT (US)

(73) Assignee: Cable Components Group, Pawcatuck, CT (US)

( * ) Notice: Subject to any disclaimer, the term of this patent is extended or adjusted under 35 U.S.C. 154(b) by 0 days.

(21) Appl. No.: 11/408,444

(22) Filed: Apr. 21, 2006

(65) Prior Publication Data

US 2006/0237217 A1 Oct. 26, 2006

Related U.S. Application Data

(60) Provisional application No. 60/674,526, filed on Apr. 25, 2005.

(51) Int. Cl.
*H01B 7/00* (2006.01)

(52) U.S. Cl. ..... 174/113 R; 174/113 C

(58) Field of Classification Search ..... 174/36, 174/110 R, 113 R, 113 C, 120 R, 115, 116, 174/70 R, 72 R, 72 C; 138/111, 113, 114, 138/115

See application file for complete search history.

(56) References Cited

U.S. PATENT DOCUMENTS

| | | | | | |
|---|---|---|---|---|---|
| 1,804,478 | A | * | 5/1931 | Parker | 138/112 |
| 2,144,872 | A | * | 1/1939 | Cruser | 174/95 |
| 2,916,055 | A | * | 12/1959 | Brumbach | 138/111 |
| 3,357,455 | A | * | 12/1967 | Plummer | 138/106 |
| 3,819,443 | A | | 6/1974 | Simons et al. | |
| 3,964,563 | A | * | 6/1976 | Allen | 180/217 |
| 4,086,427 | A | * | 4/1978 | Nasuta et al. | 174/88 C |
| 4,271,104 | A | | 6/1981 | Anderson et al. | |
| 4,582,093 | A | * | 4/1986 | Hubbard et al. | 138/111 |
| 4,605,818 | A | | 8/1986 | Arroyo et al. | |
| 4,709,730 | A | * | 12/1987 | Zwilling | 138/111 |
| 4,755,629 | A | | 7/1988 | Beggs et al. | |
| 4,804,020 | A | * | 2/1989 | Bartholomew | 138/111 |
| 5,036,891 | A | * | 8/1991 | Vogelsang | 138/115 |
| 5,069,254 | A | * | 12/1991 | Vogelsang | 138/111 |
| 5,146,528 | A | | 9/1992 | Gleim et al. | |

(Continued)

FOREIGN PATENT DOCUMENTS

DE 3217401 A1 * 11/1983

(Continued)

OTHER PUBLICATIONS

EIA / TIA CAT 6 Specifications Draft, Version 2.0, Jun. 21, 2005.

*Primary Examiner*—William H Mayo, III
(74) *Attorney, Agent, or Firm*—Guerry L. Grune; ePatent Manager.com

(57) ABSTRACT

The present invention describes a conduit tube like structure for high performance, multi-media communications cables with or without support separators that are of varying internal and external dimensions and wall thickness that may vary consistently or randomly and may be spirally or helically wound within or around a high performance, multi-media communications cable to vary the spacing between a high performance, multi-media communications cable and an adjacent communications cable. The conduit tube structures may be hollow, contain communications media, solid comprised of various shapes and wrapped with various windings and/or tensions. The final cable assembly may then be jacketed or taped as desired.

27 Claims, 1 Drawing Sheet

U.S. PATENT DOCUMENTS 5,418,878 A 5/1995 Sass et al.
5,444,184 A 8/1995 Hassel
5,544,270 A 8/1996 Clark et al.
5,703,330 A * 12/1997 Kujawski ..... 174/72 A
5,742,982 A * 4/1998 Dodd et al. ..... 24/16 R
5,789,711 A 8/1998 Gaeris et al.
5,821,466 A 10/1998 Clark et al.
5,887,243 A 3/1999 Harvey et al.
5,952,615 A 9/1999 Prudhon
5,969,295 A 10/1999 Boucino et al.
5,973,265 A * 10/1999 O'Brien et al. ..... 174/72 A
6,008,455 A 12/1999 Lindstrom et al.
6,074,503 A 6/2000 Clark et al.
6,091,025 A 7/2000 Cotter et al.
6,150,612 A 11/2000 Grandy et al.
6,353,186 B1 * 3/2002 Dams et al. ..... 174/667
6,365,836 B1 4/2002 Blouin et al.
6,426,462 B1 * 7/2002 Mignon et al. ..... 174/651
6,596,944 B1 7/2003 Clark et al.
6,639,152 B2 10/2003 Glew et al.
6,680,922 B1 1/2004 Jorgensen
6,686,537 B1 2/2004 Gaeris et al.
6,687,437 B1 * 2/2004 Starnes et al. ..... 385/101
6,689,958 B1 2/2004 McKenney et al.
6,748,146 B2 6/2004 Parris
6,751,441 B1 6/2004 Murray et al.
6,774,311 B1 * 8/2004 Byun ..... 174/95
6,792,184 B2 9/2004 Conrad et al.
6,800,811 B1 10/2004 Boucino
6,812,408 B2 11/2004 Clark et al.
6,818,832 B2 11/2004 Hopkinson et al.
6,855,889 B2 2/2005 Gaeris
2002/0037376 A1 * 3/2002 Fenton ..... 428/34.9
2004/0002559 A1 1/2004 Troutman et al.
2004/0055779 A1 3/2004 Wiekhorst et al.
2004/0055781 A1 3/2004 Comibert et al.
2004/0118593 A1 6/2004 Augustine et al.
2004/0149483 A1 8/2004 Glew
2004/0198875 A1 10/2004 Kaprinidis et al.
2004/0216914 A1 * 11/2004 Vexler et al. ..... 174/121 A
2004/0217329 A1 11/2004 Easter
2004/0256139 A1 12/2004 Clark et al.
2005/0006132 A1 1/2005 Clark
2005/0006133 A1 1/2005 Greiner
2005/0023028 A1 2/2005 Clark
2005/0029007 A1 2/2005 Nordin et al.
2005/0051355 A1 3/2005 Bricker et al.
2005/0056454 A1 3/2005 Clark
2005/0063650 A1 3/2005 Castellani et al.

FOREIGN PATENT DOCUMENTS

DE GB 2 258 286 A * 1/1991
EP 0957494 B1 11/2004
JP 07122123 A2 5/1995
JP 07-245023 * 9/1995
WO WO 96/24143 8/1996
WO WO 01/01535 A1 * 1/2001
WO WO2004/021367 3/2004
WO WO 2004042446 A1 5/2004

* cited by examiner

VARIABLE DIAMETER CONDUIT TUBES FOR HIGH PERFORMANCE, MULTI-MEDIA COMMUNICATION CABLE

This application takes priority from U.S. Provisional Application No. 60/674,526, entitled, "Concentric-Eccentric High Performance Support-Separators for Multi-Media Cables Including Conduit Tubes Utilizing Roll-up Designs", filed on Apr. 25, 2005.

FIELD OF THE INVENTION

This invention relates to high performance multi-media communications cables utilizing paired or unpaired electrical conductors or optical fibers that meet stringent electrical as well as smoke and flame suppression requirements. More particularly, it relates to unique cables having a central core defining individual conductor pair channels. The communications cables have interior core support-separators that define a clearance through which conductors or optical fibers may be disposed and these separators as well as the cables and the method for producing such are the subject of the present invention. The invention also pertains to conduit tubes that could be used in conjunction with or separately from the separators with the defined clearance channels. These conduit tubes may be round, square, rectangular, elliptical or in any feasible geometric shape that would allow for any communications media conductor to be placed or subsequently blown (by pneumatic or other means) into place along the length of these tubes. In the present invention, the tubes are used for providing both asymmetry and symmetry using both eccentric and concentric shapes to ensure optimal electrical, optical, and mechanical properties. Additionally and concurrently, the present invention relates to composite electrical insulation exhibiting reduced flame spread and reduced smoke evolution, while maintaining favorable and optimal electrical properties within the conductors and/or cables. The present invention also relates to insulated electrical conductors and jacketed plenum cable formed from the flame retardant and smoke suppressant composite insulation(s). The focus of the present invention also includes the unique concept of a providing an eventually rolled-up version of an initially flat-ribbon like construction that ensures separator function. The rolled-up versions must be capable of supporting multi-media communications transmission mediums—including optical fiber, low voltage power and low voltage communications copper conductors, and may be comprised of non-conductive, semi conductive, and conductive materials that may be organic or inorganic, filled and from virgin resin or regrind and with no filler or any combination thereof, and also optionally comprising tapes, shields, foamed, solid or hollow tubes as well as foamed, solid, or hollow flat-ribbons that once rolled upon themselves function as support-separators.

This invention also relates to high performance multi-media communications cables utilizing paired or unpaired electrical conductors or optical fibers that also meet the newer transmission requirements of three main standards developed as IEEE 802.11 (a), (b), and (g) adopted in both in the United States under the National Electric Code (NEC) and internationally through the guidelines established by the International Electrotechnical Commission (IEC). Additional standards have been proposed within IEEE 802.3(a)(f) for integrating communications cabling and low voltage power source capabilities within the same cable structure. Allowable voltages and wattages will be greater than the current standards Specifically, the present invention also relates to cables having a central core defining individual conductor pair channels that are capable of meeting the needs of the recently created wireless LAN (local area network) market place.

Specifically, wireless networks for laptop computing and wireless network access points (antennae) that transmit and receive wireless signals need to comply with IEEE standard 802.11a, 802.11b and 802.11g. Low voltage conductors that are included in the central core either for or as antennae are also capable of being used for additional purposes including the need for transmission of power or frequency other than specifically for wireless applications such as powering hubs and routers for a communications network or providing alternative voice or data transmission lines or even in lieu of batteries that would be used to power cameras or other network remote devices. The power from these devices is converted from the 110 VAC to 12-24 VDC, but can be as high as 48 VDC at a maximum of 12 W. Currently the conductors being used are 22-24 AWG used, but larger AWG conductors are anticipated in order to maintain higher wattages associated with increased low voltages as determined by the application.

BACKGROUND OF THE INVENTION

Many communication systems utilize high performance cables normally having four pairs or more that typically consist of two twisted pairs transmitting data and two receiving data as well as the possibility of four or more pairs multiplexing in both directions. A twisted pair is a pair of conductors twisted about each other. A transmitting twisted pair and a receiving twisted pair often form a subgroup in a cable having four twisted pairs. High-speed data communications media in current usage includes pairs of wire twisted together to form a balanced transmission line as well as the possibility of four or more pairs multiplexing in both directions. Optical fiber cables may include such twisted pairs or replace them altogether with optical transmission media (fiber optics).

In conventional cable, each twisted pair of conductors for a cable has a specified distance between twists along the longitudinal direction. That distance is referred to as the pair lay. When adjacent twisted pairs have the same pair lay and/or twist direction, they tend to lie within a cable and when twisted pairs are closely placed, such as in a communications cable, electrical energy may be transferred from one pair of a cable to another adjacent or outlying pair and this energy transfer between conductor pairs is undesirable and referred to as crosstalk. Therefore, in many conventional cables, each twisted pair within the cable has a unique pair lay in order to increase the spacing between pairs and thereby also reducing the crosstalk between twisted pairs of a cable. Additionally undesirable energy may be transferred between adjacent cabling conductors which is known as alien cross-talk or alien near-end cross talk (ANEXT).

The Telecommunications Industry Association and Electronics Industry Association have defined standards for crosstalk, including TIA/EIA-568 A, B, and C including the most recent edition of the specification. The International Electrotechnical Commission has also defined standards for data communication cable crosstalk, including ISO/IEC 11801. One high-performance standard for 100 MHz cable is ISO/IEC 11801, Category 5. Additionally, more stringent standards are being implemented for higher frequency cables including Category 6 and Category 7, which includes frequencies of 200 and 600 MHz, respectively and the most recent proposed industrial standard raising the speeds to 10 Gbit (10 GBASE-T) over copper with Ethernet or other cable designs. Industry standards cable specifications and known commercially available products are listed in Table 1 and a set of updated standards is forthcoming from the EIA committee and should be considered as part of this disclosure. IEEE 802.3(a)(f) was presented as a topic of discussion in the Nov.

14-19, 2004 IEEE plenary session and includes topics such as Carrier Sense Multiple Access with Collision Detection (CSMA/CD) Access Method and Physical Layer Specifications, Data Terminal Equipment (DTE) and Power via Media Dependent Interface (MDI). Changes to MDI most pertinent to the present invention is that even low power conductors may emit undesirable energy into the twisted pair conductors promoting undesirable cross-talk between the power source and the communications conductors. As higher power is allowed in the MDI and data bit rates increase, the communications conductors become even more susceptible to cross-talk and data transmission reliability issues. Present Category 6 standards are listed in Tables 2A-2G.

Another feature of this invention will be to selectively add conductive materials in appropriate amounts to non-conductive or semi-conductive materials that comprise the separator structure (prior to roll-up or after roll-up depending on the design of choice) in order to attenuate any cross talk between the conductor and other communications or power conducting cables. Additionally, when conductive material is added to the configuration of the separators of the present invention, this would act as a shield against alien near end cross talk (ANEXT), or stray interference from adjacent cables or from disrupting communication signals from adjacent cables (far end crosstalk-FEXT).

Addition of conductive materials (moralization and the like) in relatively small concentrations either within the insulation of the separators or on exterior surfaces also decreases the weight of the cable. Presently, shielding, such as aluminized Mylar®, on curved linear surfaces is difficult in that it provides for unique and costly designs. This invention minimizes this difficulty by allowing for application of the aluminized film (PE, PET, Mylar®, etc.) on a flat or ribbon configuration prior to adding curved linearity to provide (upon roll-up) the cable support-separator.

Cabling exists today that is claimed to operate reliably without cross talk between the power cable and the communication cables at 48 VDC and up to 12 W (0.25 A). As the IEEE looks forward to providing the next generation of cable standards, the need for higher power is becoming a reality. Cabling that will enable up to 60 VDC and 30 W, within a cable structure comprising fiber optic or twisted pair communications, and no crosstalk between the power cable and the communications lines as well as ensuring reliable communications operation (not subject to alien cross talk from other communications cable), is required. This invention discloses several cabling and separator system configurations allowing for component constructions that will meet the newly proposed IEEE standards.

TABLE 1

INDUSTRY STANDARD CABLE SPECIFICATIONS

| ALL DATA AT 100 MHz | TIA CAT 5e | TIA CAT 6 DRAFT 10 Nov. 15, 2001 | ANIXTER XP6 R3.00XP November 2000 | ANIXTER XP7 R3.00XP November 2000 |
|---|---|---|---|---|
| MAX TEST FREQUENCY | 100 MHz | 250 MHz | 250 MHz | 350 MHz |
| ATTENTUATION | 22.0 db | 19.8 db | 21.7 db | 19.7 db |
| POWER SUM NEXT | 32.3 db | 42.3 db | 34.3 db | 44.3 db |
| ACR | 13.3 db | 24.5 db | | |
| POWER SUM ACR | 10.3 db | 22.5 db | 12.6 db | 23.6 db |
| POWER SUM ELFEXT | 20.8 db | 24.8 db | 23.8 db | 25.8 db |
| RETURN LOSS | 20.1 db | 20.1 db | 21.5 db | 22.5 db |

TABLE 2A

Return Loss Requirements for Category 6 Cable
Return loss @ 20° C. ± 3° C. (68° F. ± 5.5° F.), worst pair for a length of 100 m (328 ft)

| Frequency MHz | Category 6 dB |
|---|---|
| $1 \leqq f \leqq 10$ | $20 + 5 \log (f)$ |
| $10 \leqq f \leqq 20$ | 25 |
| $20 \leqq f \leqq 250$ | $25 - 7 \log (f/20)$ |

TABLE 2B

Insertion Loss Requirements for Category 6 Cable
Insertion loss @ 20° C. ± 3° C. (68° F. ± 5.5° F.), worst pair for a length of 100 m (328 ft)

| Frequency MHz | Category 6 dB |
|---|---|
| .772 | 1.8 |
| 10.0 | 6.0 |
| 250.0 | 32.8 |

TABLE 2C

Near End Crosstalk Requirements
For Category 6 Cable
Horizontal cable NEXT loss @ 20° C. ± 3° C. (68° F. ± 5.5° F.), worst pair-to-pair, for a length of 100 m (328 ft)

| Frequency MHz | Category 6 dB |
|---|---|
| 0.150 | 86.7 |
| 10.0 | 59.3 |
| 250.0 | 38.3 |

TABLE 2D

| Power Sum Near End Crosstalk Requirements for Category 6 Cable PSNEXT loss @ 20° C. ± 3° C. (68° F. ± 5.5° F.), for a length of 100 m (328 ft) | |
|---|---|
| Frequency MHz | Category 6 dB |
| 0.150 | 84.7 |
| 10.0 | 57.3 |
| 250.0 | 36.3 |

TABLE 2E

| Equal Level Near End Crosstalk Requirements For Category 6 Cable ELNEXT loss @ 20° C. ± 3° C. (68° F. ± 5.5° F.), worst pair-to-pair for a length of 100 m (328 ft) | |
|---|---|
| Frequency MHz | Category 6 dB |
| .772 | 70.0 |
| 10.0 | 47.8 |
| 250.0 | 19.8 |

TABLE 2F

| Power Sum Equal Level Near End Crosstalk Requirements for Category 6 Cable PSELNEXT loss @ 20° C. ± 3° C. (68° F. ± 5.5° F.), for a length of 100 m (328 ft) | |
|---|---|
| Frequency MHz | Category 6 dB |
| .772 | 67.0 |
| 10.0 | 44.8 |
| 250.0 | 16.8 |

TABLE 2G

| Proposed Requirements for Alien Near-end Cross-talk for Category 6 Cable Proposed Requirements for Channel Power Sum Alien Near-End Cross-talk | |
|---|---|
| Frequency | Category 6 dB |
| PSANEXT $\geqq$ 60 − 10log(f) | $1 \leqq f \leqq 100$ MHz |
| PSANEXT $\geqq$ 60 − 15log(f) | $100 \leqq f \leqq 625$ MHz |

In conventional cable, each twisted pair of conductors for a cable has a specified distance between twists along the longitudinal direction. That distance is referred to as the pair lay. When adjacent twisted pairs have the same pair lay and/or twist direction, they tend to lie within a cable more closely spaced than when they have different pair lays and/or twist direction. Such close spacing increases the amount of undesirable crosstalk that occurs. Therefore, in many conventional cables, each twisted pair within the cable has a unique pair lay in order to increase the spacing between pairs and thereby to reduce the crosstalk between twisted pairs of a cable. Twist direction may also be varied.

Along with varying pair lays and twist directions, individual solid metal or woven metal air shields are used to electro-magnetically isolate pairs from each other or isolate the pairs from the cable jacket or low power conduction. Shielded cable exhibits better cross-talk isolation but is more time consuming and costly to manufacture, install, and terminate. Individually shielded pairs must generally be terminated using special tools, devices and techniques adapted for the job, also increasing cost and difficulty.

One popular cable type meeting the above specifications is Unshielded Twisted Pair (UTP) cable. Because it does not include shielded pairs, UTP is preferred by installers and others associated with wiring building premises, as it is easily installed and terminated. However, UTP fails to achieve superior cross-talk isolation such as required by the evolving higher frequency standards for data and other state of the art transmission cable systems, even when varying pair lays are used.

Another popular cable type is the "Banana Peel®" cable manufactured by Belden Electronics and published as PCT Application WO2004/021367A3 which allows the user to "peel" individual conductor sets from the central core cable support-separator. The wire jackets are bonded together with a suitable adhesive. This design aids in stripping and termination of the individual conductive media by the installer.

Some cables have used supports in connection with twisted pairs. These cables, however, suggest using a standard "X", or "+" shaped support, hereinafter both referred to as the "X" support. Protrusions may extend from the standard "X" support. The protrusions of these prior inventions have exhibited substantially parallel sides.

The document, U.S. Pat. No. 3,819,443, hereby incorporated by reference, describes a shielding member comprising laminated strips of metal and plastics material that are cut, bent, and assembled together to define radial branches on said member. It also describes a cable including a set of conductors arranged in pairs, said shielding member and an insulative outer sheath around the set of conductors. In this cable the shielding member with the radial branches compartmentalizes the interior of the cable. The various pairs of the cable are therefore separated from each other, but each is only partially shielded, which is not so effective as shielding around each pair and is not always satisfactory.

The solution to the problem of twisted pairs lying too closely together within a cable is embodied in three U.S. Pat. No. 6,150,612 to Prestolite, U.S. Pat. No. 5,952,615 to Filotex, and U.S. Pat. No. 5,969,295 to CommScope incorporated by reference herein, as well as an earlier similar design of a cable manufactured by Belden Wire & Cable Company as product number 1711A. The prongs or splines in the Belden cable provide superior crush resistance to the protrusions of the standard "X" support. The superior crush resistance better preserves the geometry of the pairs relative to each other and of the pairs relative to the other parts of the cables such as the shield. In addition, the prongs or splines in this invention preferably have a pointed or slightly rounded apex top which easily accommodates an overall shield. These cables include four or more twisted pair media radially disposed about a "+"-shaped core. Each twisted pair nests between two fins of the "+"-shaped core, being separated from adjacent twisted pairs by the core. This helps reduce and stabilize crosstalk between the twisted pair media. U.S. Pat. No. 5,789,711 to Belden describes a "star" separator that accomplishes much of what has been described above and is also herein incorporated by reference.

However, these core types can add substantial cost to the cable, as well as excess material mass which forms a potential fire hazard, as explained below, while achieving a crosstalk reduction of typically 3 dB or more. This crosstalk value is based on a cable comprised of a fluorinated ethylene-propylene (FEP) insulated conductors with PVC jackets as well as cables constructed of FEP jackets with FEP insulated conductors. Cables, where no separations between pairs exist, will exhibit smaller cross-talk values. When pairs are allowed to shift based on "free space" within the confines of the cable jacket, the fact that the pairs may "float" within a free space can reduce overall attenuation values due to the ability to use a larger conductors to maintain 100 ohm impedance. The trade-off with allowing the pairs to float is that the pair of conductors tend to separate slightly and randomly. This undesirable separation contributes to increased structural return loss (SRL) and more variation in impedance. One method to overcome this undesirable trait is to twist the conductor pairs with a very tight lay. This method has been proven impractical because such tight lays are expensive and greatly limit the cable manufacturer's throughput and overall production yield. An improvement included by the present invention to structural return loss and improved attenuation is to provide grooves within channels for conductor pairs such that the pairs are fixedly adhered to the walls of these grooves or at least forced within a confined space to prevent floating simply by geometric configuration. This configuration is both described here within and referenced in U.S. Pat. No. 6,639,152 filed Aug. 25, 2001 as well as the international application PCT/US02/13831 filed at the United States Patent and Trademark Office on May 01, 2002. Both the patent and the pending application are hereby specifically incorporated by reference.

In addition to the preceding portion of the invention, U.S. Pat. Nos. 6,680,922, 5,887,243, 5,444,184, 5,418,878, and 6,751,441 are hereby also incorporated by reference regarding the use of lower voltage power conductors for wireless fidelity applications and the like.

U.S. Pat. No. 6,680,922 refers to a packet-centric wireless point to multi-point telecommunications system comprising a wireless base station coupled to a data network, workstations, subscriber customer premise equipment (CPE) in wireless communication, sharing a wireless bandwidth using a packet-centric protocol and at least one layer above layer 4 of Open Systems Interconnect (OSI) model.

U.S. Pat. No. 5,887,243 includes a method of generating and delivering an individualized mass medium program presentation at a receiver station, a computer for generating and communicating information, and at least one output device operatively connected to a viewer with at least one data storage location.

U.S. Pat. No. 5,444,184 references an apparatus for transmitting communication signals and electrical power signals between two remote locations, comprising at least two twisted pairs having at least one twisted pair for transmitting the communication signals, and having conductors connected in parallel for transmitting electrical power signals; and a transformer means being connected to at least two twisted pairs for separating the transmission of the communication signals and the electrical power signals. The patent describes a communication cable that has at least two twisted pairs and at least two power conductors and may further comprises three paired power conductors for transmission of three phase power, the three paired power conductors being used for transmitting three communication channels.

U.S. Pat. No. 5,418,878 describes an invention that seeks to provide an electrical telecommunications cable construction in which pair-to-pair capacitance unbalance and cross-talk is minimized. Accordingly, this invention provides an electrical telecommunications cable comprising a plurality of pairs of individually insulated conductors, the conductors in each pair twisted together, and spacer means holding the pairs of conductors spaced apart. The spacing means is provided by projections extending inwardly from the jacket or outwardly and are spaced circumferentially around the jacket to provide spacers so the pairs of conductors are separated from one another by the projections.

U.S. Pat. No. 6,751,441 describes a premises, connected to receive broadband service(s) and also connected to a cable system, and provides a broadband interface which connects to in-premises cabling which is coupled to consumer receivers such as television sets, PDAs, and laptops. Connected to the broadband interface is an adjunct device which channels broadband, data and voice signals supplied to an in-premises wireless system as distinguished from the signals supplied to the cable connected consumer receivers. The adjunct device formats the broadband and voice signals or any broadband service into packet format suitable for signal radiation and couples them to the in-premises coax cabling, via a diplexer, at a selected location. At a second cable location a second diplexer, connected to the cable, separates the broadband, data and voice signals and couples them to a signal radiation device (i.e., an RF antenna or leaky coaxial cable) that radiates the signal to the immediate surrounding location. Various devices, near the second cable location for specific services, receive the wireless signals (i.e., broadband, data and voice) from the radiating antenna.

U.S. Pat. No. 6,596,544 by Clark, et. al., and assigned to CDT/Mohawk, describes a data cable comprising a non-conductive central core providing channels for a plurality of twisted pairs of conductors all enclosed in a non-conductive unshielded jacket.

U.S. Pat. No. 6,596,503 by Clark, et. al., and assigned to CDT/Mohawk, describes a method of inserting communication media onto the channels for constructing a data communications cable.

U.S. Pat. No. 4,605,818 by Arroyo, et. al., and assigned to AT&T/Bell Labs, describes a cable construction comprising a central core, data communications media and a jacket enclosing the core and communications media wherein the jacket is comprised of an impregnated woven material, with impregnative additives proportional to the number and type of media to resist heat, effectively delaying the decomposition of the media and core enclosed within.

U.S. Pat. No. 6,008,455 by Lindstrom, et. al., and assigned to Ericsson, describes fixating three or more conductors in a mutually parallel and spaced relationship to minimize data transmission skew and to avoid bit error.

U.S. Pat. No. 4,271,104 by Anderson, et. al., and assigned to Honeywell, describes a method for producing a unitary ribbon like sheet of optic fiber which is effectively optically separated into a plurality of parallel optical paths forming the optically transparent material into a ribbon like sheet.

U.S. Pat. No. 6,818,832 by Hopkinson, et. al., and assigned to Commscope Solutions Properties, LLC, describes a cable comprising a plurality of twisted pairs of conductors and a crossweb running longitudinally along at least a portion of a length of the twisted pairs of conductors wherein at least one of the fins has a substantially elliptical shape thereby spacing the adjoining conductor pair at a maximum spacing within a cable.

U.S. Pat. No. 6,365,836 by Blouin, et. al., and assigned to NORDX/CDT, describes a generally cross-shaped core with a plurality of twisted pairs of insulated conductors with each twisted pair of insulated conductors in stable positions apart from each other and a jacket generally surrounding the plurality of twisted pairs of insulated conductors and the core being held at a distance away from adjacent cabling as defined by the jacket outer surface.

U.S. Pat. No. 6,091,025 by Cotter, et. al., and assigned to Khamsin Technologies, LLC, describes core support-separators comprising two identical portions that when placed back to back define a quadrant cross-section of channels in which to place twisted pairs of communication media.

U.S. Pat. No. 4,755,629 by Beggs, et. al., and assigned to AT&T/Bell Labs, describes a communications cable, which comprises a dielectric material and which includes a plurality of portions each of which is associated individually with a pair of the conductors. Each of the dielectric portions have a thickness which is equal at least to the radius of the metallic conductor of an associated insulated conductor to suitably space each pair of insulated conductors.

U.S. Pat. No. 6,748,146 by Parris, and assigned to Corning Cabling Systems, describes at least one optical fiber being at least partially embedded within at least one material with at least one material forming a housing that protects the optical fiber.

U.S. Pat. No. 6,855,889 by Gaeris, and assigned to Belden Wire & Cable Co., describes a twisted-pair cable separator spline comprising: a longitudinally extending spline having a plurality of spaced longitudinally extending open pockets, a cross-section of said spline having a major axis and a minor axis and at least one pocket being on the major axis, and at least one pocket being on the minor axis, and wherein the major axis has a length greater than a length of said minor axis.

U.S. Pat. No. 6,812,418 by Clark, et. al., and assigned to CDT/Mohawk, describes a configurable tape separator that separates the first twisted pair of insulated conductors from the second twisted pair of insulated conductors without completely surrounding any one twisted pair of the plurality of twisted pairs of insulated conductors all enclosed within a surrounding sheath.

U.S. Pat. No. 6,800,811 by Boucino, and assigned to Commscope Solutions Properties, LLC, describes a communications cable comprising a cable jacket and a spacer extending within the cable jacket with the spacer having a longitudinally extending center portion and plurality of longitudinally extending wall portions radiating from the center portion with the longitudinally extending wall portions increasing in thickness over only a portion of the walls wherewith, within a jacket, the spacer and the cable jacket defining a plurality of compartments for the twisted pair of conductors.

U.S. Pat. No. 6,686,537 by Gaeris, et. al., and assigned to Belden Wire & Cable Co., describes an individual bound lateral shielded twisted pair data cable and a first composite tape having a non-metal base and a layer of metal on one side of the base, and a second composite tape having a non-metal base and a layer of metal on both sides of the base and wrapped around a twisted pair of conductors.

U.S. Pat. No. 5,146,528 by Gleim, et. al., and assigned to Deutsch Thompson-Brandt Gmbh, describes a cable for conducting simultaneously electricity and light comprised of optically conductive material for conducting light therethrough, so that electrical signals can be conducted through said core simultaneously with light signals through said insulation layer.

U.S. Pat. No. 6,792,184 by Conrad, et. al., and assigned to Corning Cabling Systems, describes a fiber optic ribbon having plurality of optical fibers arranged in a generally planar configuration.

U.S. Pat. No. 6,689,958 by McKinney, et. al., and assigned to Parlex Corp., describes a ribbon cable having a length and a width where the ribbon cable comprises a plurality of parallel spaced conductors located in a first plane, each of the plurality of conductors having conductor end portions at opposing ends and a central conductor portion between the conductor end portions, the conductor end portions having a generally circular cross section and a drain wire located generally in a second plane spaced from the first plane by a predetermined distance and a conductive shield layer laminated to one of the opposing surfaces of an insulating material and the shield layer being conductively coupled to the drain wire.

US patent application 20050063650A1 by Castellani, et. al., describes a telecommunication cable comprising a tubular element of polymeric material and at least one transmission element housed within.

US patent application 20040217329A1 by Easter, et. al., describes a semiconductive resin layer in contact with a crosslinked wire and cable insulation layer, wherein the insulation layer is crosslinked using a peroxide cure system to lightly bond the semiconductive resin layer and cable insulation layer.

US patent application 20040149483A1 by Glew, and assigned to Cable Components Group, LLC., describes communications cable comprising an interior support, a central region with an external radial and axial surface, and an interior support comprising at least one anvil shaped core support-separator section radially and axially defined by the central region.

US patent application 20050006133A1 by Greiner, et. al., describes a multiconductor arrangement for either power or data transmission.

US patent application 20050006132A1 by Clark, and assigned to CDT/Mohawk, describes a method of manufacture of a data cable wherein the step of extruding the core includes stretching the core material at a plurality of intervals during extrusion so as to form a corresponding plurality of pinch points along a length of the core such that a diameter of the core at the pinch points is substantially reduced relative to a maximum diameter of the core.

US patent application 20050051355A1 by Bricker, et. al., describes a jacket comprising at least one spline projecting inward from an inner surface of the jacket, wherein at least a portion of a conductive twisted pair is positioned between the spline and a center core, thereby preventing relative movement of the jacket with respect to the core.

US patent application 20050029007A1 by Nordin, et. al., and assigned to Panduit Corp., describes a system for reducing alien crosstalk in a communication network via patch cords to attenuate signals between communications media.

US patent application 20050023028A1 by Clark, describes data communication cable comprising: a plurality of twisted pairs of insulated conductors, each twisted pair comprising two electrical conductors, each surrounded by an insulating layer and twisted together to form the twisted pair; and a jacket substantially enclosing the plurality of twisted pairs of insulating conductors; wherein the insulating layer includes a dielectric material comprising a plurality of micro-particles.

US patent application 20040216914A1 by Gavriel, et. al., and assigned to NORDX/CDT, describes a cable wire comprising a conductor and at least one inner insulating layer surrounding the conductor with at least one of the inner layers being a nano-composite comprising nano-sized platelets and a flame and smoke retardant additive package dispersed within a polyolefin matrix.

US patent application 20040118593A1 by Augustine, et. al., describes an electrical data cable having reduced crosstalk characteristics comprising at least two generally flat tape separators placed in between the plurality of twisted conductor pairs.

US patent application 20040055781A1 by Cornibert, et. al., and assigned to NORDX/CDT, describes a cable separator spline wherein a pair of longitudinally extending walls includes a first wall substantially thicker than a second wall.

US patent application 20040055779A1 by Wiekhorst, et. al., describes a cable construction of components extending along a longitudinal axis and including at least one first channel wherein the component is grooved.

US patent application 20040256139A1 by Clark, et. al., describes an insulated conductor comprising a conductive core and a first insulating layer surrounding the conductive core and the conductive core has an irregularly shaped outer circumference.

US patent application 20050056454A1 by Clark, describes a cabling scenario wherein a first twisted pair of conductors is wrapped with an insulative material of a measured dielectric constant, a second twisted pair of a second dielectric constant and a third pair of a third dielectric constant by wrapping the twisted pairs with cumulative layers of various dielectric constant electrical properties.

U.S. Pat. No. 5,821,466 by Clark, et. al., describes a cable system whereby a first twisted pair of conductors is wrapped in a second pair of twisted pair of conductors with substantial contact and a third twisted pair of conductors is substantially wrapped around the second twisted pair of conductors to increase mechanical stability of the concentrically twisted pairs of conductors.

U.S. Pat. No. 5,544,270 by Clark, et. al., describes a twisted pair of conductors substantially wrapped around a central core and a jacket wherein a second pair of twisted conductors is wrapped around the first and subsequently wrapped in a second jacket.

International patent application WO2004/021,367 by Schuman, et. al., and assigned to Belden Technologies, describes multi-member cables which are compromised of jacketed cables whose jackets are adhered together without the use of an adhesive element, such as by co-forming the jackets, and methods for manufacturing such cables are also discussed. Generally, the components will be separated from the mufti-member cable by an installer.

International patent application WO1996/024143 by Hardie, et. al., and assigned to WL Gore, describes a high speed data transmission with a cable differential pair comprising two conductors generally 180 degrees apart from each other wherein the distance between any of the conductors and the shield is substantially equal to or greater than the distance between that conductor and the center axis of the cable.

International patent application WO2004/042446A1 by Ishikawa, et. al., and assigned to and assigned to Sumitomo Electric Inc. Ltd., describes an optical fiber ribbon comprising a plurality of optical fibers which are arranged in parallel and a resin which integrates the plurality of optical fibers over the whole length of the optical fibers.

Japan patent application JP07122123A2 by Kazuhiro, et. al., and assigned to Sumitomo Electric Co, Ltd., describes a ribbon cable that is rolled to form a unit cable around a central core.

European patent application EP0957494B1 by Keller, and assigned to Alcatel, describes a composite cable for providing electrical signals and optical signals comprising twisted pairs of wires and optical fiber media.

Finally, U.S. Pat. No. 4,523,970 by Toy, and assigned to Raytheon, and hereby incorporated by reference into the body of this specification, decribes the use of ethylene-vinyl acetate copolymer and ethylene-vinyl acetate-methacrylic acid terpolymer and a rubber component comprising butyl rubber to provide am adhesive-like inner surface of components that are extruded. The use of this "tacky" adhesive like surface is part of the instant invention in that the cable and/or support-separator can make use of this technique to ensure that conductive and non-conductive media may be intentionally placed properly and also removed as desired during installation.

A broad range of electrical conductors and electrical cables are installed in modern buildings for a wide variety of uses. Such uses include data transmission between computers, voice communications, as well as control signal transmission for building security, fire alarm, and temperature control systems. These cable networks extend throughout modern office and industrial buildings, and frequently extend through the space between the dropped ceiling and the floor above. Ventilation system components are also frequently extended through this space for directing heated and chilled air to the space below the ceiling and also to direct return air exchange. The space between the dropped ceiling and the floor above is commonly referred to as the plenum area. Electrical conductors and cables extending through plenum areas are governed by special provisions of the National Electric Code ("NEC").

In building designs, many precautions are taken to resist the spread of flame and the generation of and spread of smoke throughout a building in case of an outbreak of fire. Clearly, the cable is designed to protect against loss of life and also minimize the costs of a fire due to the destruction of electrical and other equipment. Therefore, conductive media and cables for building installations are required to comply with the various flammability requirements of the National Electrical Code (NEC) in the U.S. as well as International Electrotechnical Commission (EIC) and/or the Canadian Electrical Code (CEC).

Cables intended for installation in the air handling spaces (i.e. plenums, ducts, etc.) of buildings are specifically required by NEC/CEC/IEC to pass the flame test specified by Underwriters Laboratories Inc. (UL), UL-910, or its Canadian Standards Association (CSA) equivalent, the FT6. The UL-910, FT-6, and the NFPA 262 represent the top of the fire rating hierarchy established by the NEC and CEC respectively. Also important are the UL 1666 Riser test and the IEC 60332-3C and D flammability criteria. Cables possessing these ratings, generically known as "plenum" or "plenum rated" or "riser" or "riser rated", may be substituted for cables having a lower rating (i.e. CMR, CM, CMX, FT4, FTI or their equivalents), while lower rated cables may not be used where plenum or riser rated cables are required.

In 1975, the NFPA recognized the potential flame and smoke hazards created by burning cables in plenum areas, and adopted in the NEC a standard for flame retardant and smoke suppressant cables. This standard, commonly referred to as "the Plenum Cable Standard", permits the use of cable without conduit, so long as the cable exhibits low smoke and flame retardant characteristics. The test method for measuring these characteristics is commonly referred to as the Steiner Tunnel Test. The Steiner Tunnel Test has been adapted for the burning of cables according to the following test protocols: NFPA 262, Underwriters Laboratories (U.L.) 910, or Canadian Standards Association (CSA) FT-6. The test conditions for each of the U.L. 910 Steiner Tunnel Test, CSA FT-6, and NFPA 262 are as follows: a 300,000 BTU/hour flame is applied for 20 minutes to ten 24-foot lengths of test cables mounted on a horizontal tray within a tunnel. The criteria for passing the Steiner Tunnel Test is as follows:

A. Flame spread—flame travel less than 5.0 feet.

B. Smoke generation:

1. Maximum optical density of smoke less than 0.5.

2. Average optical density of smoke less than 0.15.

Because of concerns that flame and smoke could travel along the extent of a plenum area in the event the electrical conductors and cable were involved in a fire, the National Fire Protection Association ("NFPA") has developed a standard to reduce the amount of flammable material incorporated into insulated electrical conductors and jacketed cables. Reducing the amount of flammable material would, according to the NFPA, diminish the potential of the insulating and jacket materials from spreading flames and evolving smoke to adjacent plenum areas and potentially to more distant and widespread areas throughout a building.

The products of the present invention have also been developed to support the evolving NFPA standard referenced as NFPA 255 entitled "Limited Combustible Cables" with less than 50 as a maximum smoke index and/or NFPA 259 entitled "Heat of Combustion" which includes the use of an oxygen bomb calorimeter that allows for materials with less than 3500 BTU/lb. for incorporation into the newer cable (and conductors and separators within these cables) designs. The proposed materials of the present invention are for inclusion with high performance support-separators and conduit tubes designed to meet the new and evolving standards proposed for National Electrical Code (NEC) adoption in 2005. Table 4 below provides the specific requirements for each of the Cables conforming to NEC/CEC/IEC requirements are characterized as possessing superior resistance to ignitability, greater resistant to contribute to flame spread and generate lower levels of smoke during fires than cables having lower fire ratings. Often these properties can be anticipated by the use of measuring a Limiting Oxygen Index (LOI) for specific materials used to construct the cable. Conventional designs of data grade telecommunication cable for installations in plenum chambers have a low smoke generating jacket material, e.g. of a specially filled PVC formulation or a fluoropolymer material, surrounding a core of twisted conductor pairs, each conductor individually insulated with a fluorinated insulation layer. Cable produced as described above satisfies recognized plenum test requirements such as the "peak smoke" and "average smoke" requirements of the Underwriters Laboratories, Inc., UL910 Steiner tunnel test and/or Canadian Standards Association CSA-FT6 (Plenum Flame Test) while also achieving desired electrical performance in accordance with EIA/TIA-568 A, B, and C for high frequency signal transmission.

The newer standards are forcing industrial "norms" to change and therefore require a new and unique set of materials that will be required to achieve the new standards. These materials are the subject of the present invention and include nano-composites of clay and other inorganics such as ZnO and $TiO_2$ both also as nano-sized particles. In addition, the use of insulative or semi-conductive Buckminster fullerenes and doped fullerenes of the $C_{60}$ family, nanotubes of the same and the like are part of the present invention and offer unique properties that allow for maintaining electrical integrity as well as providing the necessary reduction in flame retardance and smoke suppression.

While the above described conventional cable, due in part to its use of fluorinated polymers, meets all of the above design criteria, the use of fluorinated polymers is extremely expensive and may account for up to 60% of the cost of a cable designed for plenum usage. A solid core of these communications cables contributes a large volume of fuel to a potential cable fire. Forming the core of a fire resistant material, such as with FEP (fluorinated ethylene-propylene), is very costly due to the volume of material used in the core, but it should help reduce flame spread over the 20-minute test period. Reducing the mass of material by redesigning the core and separators within the core is another method of reducing fuel and thereby reducing smoke generation and flame spread. For the commercial market in Europe, low smoke fire retardant polyolefin materials have been developed that will pass the EN (European Norm) 502666-Z-X Class B relative to flame spread, total heat release, related heat release, and fire growth rate. Prior to this inventive development, standard cable constructions requiring the use of the aforementioned expensive fluorinated polymers, such as FEP, would be needed to pass this rigorous test. Using low smoke fire retardant polyolefins for specially designed separators used in cables that meet the more stringent electrical requirements for Categories 6 and 7 and also pass the new norm for flammability and smoke generation is a further subject of this invention. Tables 3A, 3B, and 4 indicate categories for flame and smoke characteristics and associated test methods as discussed above.

TABLE 3A

International Classification and Flame Test Methodology for Communications Cable

| Class | Test Methods | Classification Criteria | Additional Classification |
|---|---|---|---|
| $A_{ca}$ | EN ISO 1716 | PCS ≦ 2.0 MJ/kg (1) and PCS ≦ 2.0 MJ/kg (2) | |
| $B_{1ca}$ | $FIPEC_{20}$ Scenario 2 (6) and | FS ≦ 1.75 m and $THR_{1200}$ ≦ 10 MJ and Peak HRR ≦ 20 kW and FIGRA ≦ 120 $Ws^{-1}$ | Smoke production (3, 7) and Flaming droplets/particles (4) and Acidity (5) |
| | EN 50285-2-1 | H ≦ 425 mm | |
| $B_{2ca}$ | $FIPEC_{20}$ Scenario 1 (6) and | FS ≦ 1.5 m and $THR_{1200}$ ≦ 15 MJ and Peak HRR ≦ 30 kW and FIGRA ≦ 150 $Ws^{-1}$ | Smoke production (3, 8) and Flaming droplets/particles (4) and Acidity (5) |

TABLE 3A-continued

| | | | |
|---|---|---|---|
| | EN 50285-2-1 | H ≦ 425 mm | |
| $C_{ca}$ | $FIPEC_{20}$ Scenario 1 (6) and | FS ≦ 2.0 m and $THR_{1200}$ ≦ 30 MJ and Peak HRR ≦ 60 kW and FIGRA ≦ 300 $Ws^{-1}$ | Smoke production (3, 8) and Flaming droplets/particles (4) and Acidity (5) |
| | EN 50285-2-1 | H ≦ 425 mm | |
| $D_{ca}$ | $FIPEC_{20}$ Scenario 1 (6) and | $THR_{1200}$ ≦ 70 MJ and Peak HRR ≦ 400 kW and FIGRA ≦ 1300 $Ws^{-1}$ | Smoke production (3, 8) and Flaming droplets/particles (4) |
| | EN 50285-2-1 | H ≦ 425 mm | and Acidity (5) |
| Eca | EN 50285-2-1 | H ≦ 425 mm | Acidity (5) |
| Fca | | No Performance Determined | |

(1) For the product as a whole, excluding metallic materials.
(2) For any external component (ie. Sheath) of the product.
(3) S1 = $TSP_{1200}$ ≦ 50 $M^2$ and peak SPR ≦ 0.25 $m^2/s$
S2 = $TSP_{1200}$ ≦ 400 $M^2$ and peak SPR ≦ 1.5 $m^2/s$
S3 = Not S1 or S2
(4) For $FIPEC_{20}$ Scenarios 1 and 2:
d0 = No flaming droplets/particles within 1200 s
d1 = No flaming droplets/particles persisting longer than 10 s within 1200 s
d3 = not d0 or d1
(5) EN 50285-2-1: (?)
A1 = conductivity < 2.5 μS/mm and pH > 4.3
A2 = conductivity < 10 μS/mm and pH > 4.3
A3 = not A1 or A2
No declaration = No Performance Determined
(6) Airflow into chamber shall be set to 8000 +/− 800 l/min.
$FIPEC_{20}$ Scen.1 = prEN50399-2-1 with mounting and fixing according to Annex 2
$FIPEC_{20}$ Scen.2 = prEN50399-2-2 with mounting and fixing according to Annex 2
(7) The smoke class declared in class B1ca cables must originate from the $FIPEC_{20}$ Scen.2 test
(8) The smoke class declared in class B2ca cables must originate from the $FIPEC_{20}$ Scen.1 test International Classification and Test Methodology for Communications Cable Pending CPD Euro-Classes for Cables

| | |
|---|---|
| PCS = gross calorific potential | FIGRA = fire growth rate |
| FS = flame spread (damaged length) | TSP = total smoke production |
| THR = total heat release | SPR = smoke production rate |
| HRR = heat release rate | H = flame spread |

Pending CPD Euro-Classes for Communications & Energy Cables

| | | |
|---|---|---|
| [A1] | EN ISO 1716 | Mineral Filled Circuit Integrity Cables |
| [B1] | FIPEC Sc.2/EN 50265-2-1 | LCC/HIFT - type LAN Comm. Cables |
| [B2] | FIPEC Sc.1/EN 50265-2-1 | Energy Cables |
| [C] | FIPEC Sc.1/EN 50265-2-1 | High FR/Riser-type Cables |
| [D] | FIPEC Sc.1/EN 50265-2-1 | IEC 332.3C type Cables |
| [E] | EN 50265-2-1 | IEC 332.1/VW1 type Cables |
| [F] | | No Requirement |

TABLE 4

Flammability Test Methods and Level of Severity for Wire and Cable

| Test Method | Ignition Source Output | Airflow | Duration |
|---|---|---|---|
| UL2424/NFPA 259/255/UL723 | 8 MJ/kg (35,000 BTU/lb.) | — | — |
| Steiner Tunnel UL 910/NFPA 262 | 88 kW (300k BTU/hr.) | 73 m/min. (240 ft/min.) forced | 20 min. |

TABLE 4-continued

Flammability Test Methods and Level of Severity for Wire and Cable

| Test Method | Ignition Source Output | Airflow | Duration |
|---|---|---|---|
| RISER UL2424/NFPA 259 | 154 kW (527K BTU/hr.) | Draft | 30 min. |
| Single Burning Item | 30 kW (102k BTU/hr.) | 36 $m^3$/min. | 30 min. (20 min burner) |
| Modified IEC 60332-3 | 30 kW (102k BTU/hr.) (Backboard behind ladder (heat impact)) | 8 $m^3$/min. | 20 min. |
| IEC 60332-3 | 20.5 kW (70k BTU/hr.) | 5 $m^3$/min. | 20 min |
| Vertical Tray | 20.5 kw (70k BTU/hr.) | Draft | 20 min |
| IEC 60332-1/ ULVW-1 | Bunsen Burner | — | 1 min (15 sec. Flame) |

Evolution of Fire Performance (Severity Levels)

| | |
|---|---|
| VW 1/IEC 60332-1/FT-1/CPD Class E | (least severe) |
| UL 1581 Tray/IEC 60332-3/FT-2/CPD Class D | ↓ |
| UL 1666 Riser/FT-4/CPD Class C & B2 | ↓ |
| NFPA 262/EN 50289/FT-6/CPD Class B1/UL 910 | ↓ |
| NFPA 255 & NFPA 259/LC/CPD Class B1+/UL 2424 | (most severe) |

Table 5 indicates material requirements for wire and cable that can meet some of the test method criteria as provided in Table 4. "Low smoke and flame compound A" is a fluoropolymer based blend that includes inorganics known to provide proper material properties such that NFPA 255 and NFPA 259 test protocols may be met.

TABLE 5

| Properties | Material Requirements and Properties for Plenum, Riser, and Halogen Free Cables: Low Smoke and Flame Compound A NFPA 255/259 LC | LSFR PVC HIFT/NFPA 262 Euro Class B1 | (Halogen Free) IEC 332.2C Class C/D | (Halogen Free) IEC 332.1 Euro Class E |
|---|---|---|---|---|
| Specific Gravity | 2.77 g/cc | 1.65 g/cc | 1.61 g/cc | 1.53 g/cc |
| Durometer D Aged, Inst/15 sec. | 69/61 | 72/63 | 59/49 | 53/47 |
| Tensile Strength, 20"/min. | 2,250 psi/15.5 Mpa | 2,500 psi/17.2 Mpa | 1,750 psi/12.1 Mpa | 1,750 psi/12.1 Mpa |
| Elongation, 20"/min. | 250% | 180% | 180% | 170% |
| Oxygen Index, (0.125") | 100+% | 53% | 53% | 35% |
| Brittle point, deg C. | −46 | −5 | −22 | −15 |
| Flexural Modulus, 0.03"/min. | 202000 psi/1400 Mpa | 56000 psi/390 Mpa | 41000 psi/280 Mpa | 49000 psi/340 MPa |
| UL Temp Rating, deg C. | 125+ | 60 | 90 | 75 |
| Dielectric Constant, 100 MHz | 2.92 | 3.25 | 3.87 | 3.57 |
| Dissipation Factor, 100 MHz | 0.012 | 0.014 | 0.015 | 0.014 |
| 4pr UTP Jkt Thickness | 9-11 mils/.23-.28 mm | 15-17 mils/.38-.43 mm | 30-40 mils/.76-1.02 mm | 20-24 mils/.50-.60 mm |

Table 6 is provided as an indicator of low acid gas generation performance for various materials currently available for producing wire and cable and cross-web designs of the present invention. The present invention includes special polymer blends that are designed to significantly reduce these values to levels such as those shown for low smoke and flame Compound A as listed above in Table 5.

TABLE 6

Acid Generation Values for Wire and Cable Insulation Materials

| Material | % Acid | PH |
|---|---|---|
| FEP | 27.18 | 1.72 |
| ECTFE | 23.890 | 1.64 |
| PVDF | 21.48 | 2.03 |
| LSFR PVC | 13.78 | 1.90 |
| Low Smoke and Flame Compound A | 1.54 | 3.01 |
| 48% LOI HFFR | 0.35 | 3.42 |
| 34% LOI HFFR | .024 | 3.94 |

Solid flame retardant/smoke suppressed polyolefins may also be used in connection with fluorinated polymers. Commercially available solid flame retardant/smoke suppressed polyolefin compounds all possess dielectric properties inferior to that of FEP and similar fluorinated polymers. In addition, they also exhibit inferior resistance to burning and generally produce more smoke than FEP under burning conditions. A combination of the two different polymer types can reduce costs while minimally sacrificing physio-chemical properties. An additional method that has been used to improve both electrical and flammability properties includes the irradiation of certain polymers that lend themselves to crosslinking. Certain polyolefins are currently in development that have proven capable of replacing fluoropolymers for passing these same stringent smoke and flammability tests for cable separators, also known as "cross-webs". Additional advantages with the polyolefins are reduction in cost and toxicity effects as measured during and after combustion. The present invention utilizes blends of fluoropolymers with primarily polyolefins as well as the use of "additives" that include $C_{60}$ fullerenes and compounds that incorporate the fullerenes and substituted fullerenes including nanotubes as well as inorganic clays and metal oxides as required for insulative or semi-conductive properties in addition to the flame and smoke suppression requirements. The use of fluoropolymer blends with other than polyolefins is also a part of the present invention and the incorporation of these other "additives" will be included as the new compounds are created. Reduction of acid gas generation is another key feature provided by the use of these blends as shown in Table 6 and another important advantage presented in the use of the cables and separators of the present invention. Price and performance characteristics for the separators and conduit tubes will determine the exact blend ratios necessary for these compounds.

A high performance communications data cable utilizing twisted pair technology must meet exacting specification with regard to data speed, electrical, as well as flammability and smoke characteristics. The electrical characteristics include specifically the ability to control impedance, near-end cross-talk (NEXT), ACR (attenuation cross-talk ratio) and shield transfer impedance. A method used for twisted pair data cables that has been tried to meet the electrical characteristics, such as controlled NEXT, is by utilizing individually shielded twisted pairs (ISTP). These shields insulate each pair from NEXT. Data cables have also used very complex lay techniques to cancel E and B (electric and magnetic fields) to control NEXT. In addition, previously manufactured data cables have been designed to meet ACR requirements by utilizing very low dielectric constant insulation materials. Use of the above techniques to control electrical characteristics have inherent problems that have lead to various cable methods and designs to overcome these problems. The blends of the present invention are designed such that these key parameters can be met.

Recently, as indicated in Tables 1, 2A and 2B, the development of "high-end" electrical properties for Category 6 and 7 cables has increased the need to determine and include power sum NEXT (near end crosstalk) and power sum ELFEXT (equal level far end crosstalk) considerations along with attenuation, impedance, and ACR values. These developments have necessitated more highly evolved separators that can provide offsetting of the electrical conductor pairs so that the lesser performing electrical pairs can be further separated from other pairs within the overall cable construction.

Recent and proposed cable standards are increasing cable maximum frequencies from 100-200 MHz to 250-700 Mhz. Recently, 10 Gbit over copper high-speed standards have been proposed. The maximum upper frequency of a cable is that frequency at which the ACR (attenuation/cross-talk ratio) is essentially equal to 1. Since attenuation increases with frequency and cross-talk decreases with frequency, the cable designer must be innovative in designing a cable with sufficiently high cross-talk. This is especially true since many conventional design concepts, fillers, and spacers may not provide sufficient cross-talk at the higher frequencies. Proposed limits for alien crosstalk have also been added to the present standards as shown in Table 2G. Such limits in many cases can only be met using the separators of the present invention.

Current separator designs must also meet the UL 910 flame and smoke criteria using both fluorinated and non-fluorinated jackets as well as fluorinated and non-fluorinated insulation materials for the conductors of these cable constructions. In Europe, the trend continues to be use of halogen free insulation for all components, which also must meet stringent flammability regulations. The use of the blends of the present invention for both separators and tube conduits will allow for meeting these requirements.

In plenum applications for voice and data transmission, electrical conductors and cables should exhibit low smoke evolution, low flame spread, and favorable electrical properties. Materials are generally selected for plenum applications such that they exhibit a balance of favorable and unfavorable properties. In this regard, each commonly employed material has a unique combination of desirable characteristics and practical limitations. Without regard to flame retardancy and smoke suppressant characteristics, olefin polymers, such as polyethylene and polypropylene, are melt extrudable thermoplastic materials having favorable electrical properties as manifested by their very low dielectric constant and low dissipation factor.

Dielectric constant is the property of an insulation material which determines the amount of electrostatic energy stored per unit potential gradient. Dielectric constant is normally expressed as a ratio. The dielectric constant of air is 1.0, while the dielectric constant for polyethylene is 2.2. Thus, the capacitance of polyethylene is 2.2 times that of air. Dielectric constant is also referred to as the Specific Inductive Capacity or Permittivity.

Dissipation factor refers to the energy lost when voltage is applied across an insulation material, and is the cotangent of the phase angle between voltage and current in a reactive component. Dissipation factor is quite sensitive to contamination of an insulation material. Dissipation factor is also referred to as the Power Factor (of dielectrics).

Fluorinated ethylene/propylene polymers exhibit electrical performance comparable to non-halogenated to olefin polymers, such as polyethylene, but are over 15 times more expensive per pound. Polyethylene also has favorable mechanical properties as a cable jacket as manifested by its tensile strength and elongation to break. However, polyethylene exhibits unfavorable flame and smoke characteristics.

Limiting Oxygen Index (ASTM D-2863) ("LOI") is a test method for determining the percent concentration of oxygen that will support flaming combustion of a test material. The greater the LOI, the less susceptible a material is to burning. In the atmosphere, there is approximately 21% oxygen, and therefore a material exhibiting an LOI of 22% or more cannot burn under ambient conditions. As pure polymers without flame retardant additives, members of the olefin family, namely, polyethylene and polypropylene, have an LOI of approximately 19. Because their LOI is less than 21, these olefins exhibit disadvantageous properties relative to flame retardancy in that they do not self-extinguish flame, but propagate flame with a high rate of heat release. Moreover, the burning melt drips on the surrounding areas, thereby further propagating the flame.

Table 7 below summarizes the electrical performance and flame retardancy characteristics of several polymeric materials. Besides fluorinated ethylene/propylene, other melt extrudable thermoplastic generally do not provide a favorable balance of properties (i.e., high LOI, low dielectric constant, and low dissipation factor). Moreover, when flame retardant and smoke suppressant additives are included within thermoplastic materials, the overall electrical properties generally deteriorate.

TABLE 7

Fire Retardancy Characteristics

| | Electrical Properties | | | | |
|---|---|---|---|---|---|
| | Dielectric Constant | Dissipation Factor | NBS Smoke Values Optical Density, DMC | | |
| Material | 1 MHz, 23 Deg. C. | 1 MHz, 23 Deg. C. | LOI % | Flaming | Non-flaming |
| PE | 2.2 | .00006-.0002 | 19 | 387 | 719 |
| FRPE | 2.6-3.0 | .003-.037 | 28-32 | — | — |
| FEP | 2.1 | .00055 | >80 | — | — |
| PVC | 2.7-3.5 | .024-.070 | 32 | 740 | 280 |
| RSFRPVC | 3.2-3.6 | .018-.080 | 39 | 200 | 190 |
| LSFRPVC | 3.5-3.8 | .038-.080 | 49 | <200 | <170 |

In the above table, PE designates polyethylene, FRPE designates polyethylene with flame retardant additives, FEP designates fluorinated ethylene/propylene polymer, PVC designates polyvinylchloride, RSFRPVC designates reduced smoke flame retardant polyvinylchloride, LSFRPVC designates low smoke flame retardant polyvinylchloride, LOI designates Limiting Oxygen Index, NBS designates the National Bureau of Standards, and DMC designates Maximum Optical Density Corrected.

In general, the electrical performance of an insulating material is enhanced by foaming or expanding the corresponding solid material. Foaming also decreases the amount of flammable material employed for a given volume of material. Accordingly, a foamed material is preferably employed to achieve a favorable balance of electrical properties and flame retardancy.

In addition to the requirement of low smoke evolution and flame spread for plenum applications, there is a growing need for enhanced electrical properties for the transmission of voice and data over twisted pair cables. In this regard, standards for electrical performance of twisted pair cables are set forth in Electronic Industry Association/Telecommunications Industry Association (EIA/TIA) document TSB 36 and 40. The standards include criteria for attenuation, impedance, crosstalk, and conductor resistance.

In the U.S. and Canada, the standards for flame retardancy for voice communication and data communication cables are stringent. The plenum cable test (U.L. 910/CSA FT-6) and riser cable test U.L. 1666 are significantly more stringent than the predominantly used International fire test IEC 332-3, which is similar to the IEEE 383/U.L. 1581 test.

Table 8 already summarizes the standards required for various U.L. (Underwriters Laboratories and CSA (Canadian Standards Authority) cable designations.

TABLE 8

U.L./CSA

| Designation | Cable Fire Test | Flame Energy |
|---|---|---|
| CMP/MPP | Plenum U.L. 910<br>CSA FT-6 Horizontal Riser | 300,000 BTUH |
| CMR/MPR | U.L. 1666 Vertical | 527,000 BTUH |
| CMG/MPG | FT-4<br>Vertical | 70,000 BTUH<br>Burner angle 20 degrees |
| CM/MP | IEEE 1581 Vertical | 70,000 BTUH<br>Burner angle 0 degrees |

As indicated above, current separator designs must also meet the UL 910 flame and smoke criteria using both fluorinated and non-fluorinated jackets as well as fluorinated and non-fluorinated insulation materials for the conductors of these cable constructions. The UL 910 criteria has been included in the recently adopted NFPA 262 criteria and extended with more severity in the NFPA 255 and 259 test criteria. To ensure that the test criteria is met, the use of the separators of the current invention is not only useful but often necessary. For meeting the NFPA 72 test criteria for circuit integrity cable, the support-separators and the materials from which they will be produced is an integral part of the present invention. The reduction in material loading (lbs/MFT) as shown in Table 9 can be an essential aspect in meeting this demand. Substantial reduction of this load by the use of separators can be achieved. The use of the polymer blends of the present invention for both separators and conduit tubes will allow for meeting the requirements for not only current circuit integrity cables but also for cables that must meet the newer more stringent requirements in the future.

Individual shielding is costly and complex to process. Individual shielding is highly susceptible to geometric instability during processing and use. In addition, the ground plane of individual shields, 360° in ISTP's—individually shielded twisted pairs is also an expensive process. Lay techniques and the associated multi-shaped anvils of the present invention to achieve such lay geometries are also complex, costly and susceptible to instability during processing and use. Another problem with many data cables is their susceptibility to deformation during manufacture and use. Deformation of the cable geometry, such as the shield, also potentially severely reduces the electrical and optical consistency.

Optical fiber cables exhibit a separate set of needs that include weight reduction (of the overall cable), optical functionality without change in optical properties and mechanical integrity to prevent damage to glass fibers. For multi-media cable, i.e. cable that contains both metal conductors and optical fibers, the set of criteria is often incompatible. The use of the present invention, however, renders these often divergent set of criteria compatible. Specifically, optical fibers must have sufficient volume in which the buffering and jacketing plenum materials (FEP and the like) covering the inner glass fibers can expand and contract over a broad temperature range without restriction, for example −40 C to 80 C experienced during shipping. It has been shown by Grune, et. al., among others, that cyclical compression and expansion directly contacting the buffered glass fiber causes excess attenuation light loss (as measured in dB) in the glass fiber. The design of the present invention allows for designation and placement of optical fibers in clearance channels provided by the support-separator having multiple shaped profiles. It would also be possible to place both glass fiber and metal conductors in the same designated clearance channel if such a design is required. In either case the forced spacing and separation from the cable jacket (or absence of a cable jacket) would eliminate the undesirable set of cyclical forces that cause excess attenuation light loss. In addition, fragile optical fibers are susceptible to mechanical damage without crush resistant members (in addition to conventional jacketing). The present invention addresses this problem by including the use of both organic and inorganic polymers as well as inorganic compounds blended with fluoropolymers to achieve the necessary properties in a non-conventional separator design.

TABLE 9

Insulation Material Criteria For Circuit Integrity Cable

| Number of Conductors | AWG size | Insulation Thickness (mils) | Jacket Thickness (mils) | Cable Diameter (in) | Approximate Weight (lbs/MFT) | Nominal Cable Lay (in./twist) |
|---|---|---|---|---|---|---|
| 2 | 16 | 35 | 40 | .34 | 59 | 3.7 |
| 2 | 14 | 35 | 40 | .36 | 75 | 4.0 |
| 2 | 12 | 35 | 50 | .42 | 106 | 4.4 |

Principal electrical criteria can be satisfied based upon the dielectric constant and dissipation factor of an insulation or jacketing material. Secondarily, the electrical criteria can be satisfied by certain aspects of the cable design such as, for example, the insulated twisted pair lay lengths. Lay length, as it pertains to wire and cable, is the axial distance required for one cabled conductor or conductor strand to complete one revolution about the axis of the cable. Tighter and/or shorter lay lengths generally improve electrical properties.

The need to improve the cable and cable separator design, reduce costs, and improve both flammability and electrical properties continues to exist.

OBJECT OF THE INVENTION

The primary objective of the invention is to provide variable diameter conduit tubes for a high performance, multi-media communications cable.

The objective initially is to provide a conduit tube, or tubes, which may exist within a plurality of twisted pairs of conductive media where plurality is defined as the state of being plural b: the state of being numerous c: a large number or quantity (Merriam-Webster Online) or exterior to a high performance, multi-media communications cable central region and also extend along the longitudinal length of the cable support-separator and where the conduit tubes provide either an eccentric or concentric cable.

Another objective is that the conduit tubes are of various shapes, random in material thickness, diameter and size, and when laid along a longitudinal length of a cable, varying the cable overall diameter and reducing or eliminating all forms of crosstalk Another objective is that the conduit tube features each or separately have a variable radial and axial diameter and where the tube features may be filled and either solid or foamed or foamed with a solid skin layer and wherein the tubes are of various shapes that are random in material thickness, diameter and size along a longitudinal length thereby varying the cable overall diameter and conductive nature of the cable.

Another objective is that the conduit tubes may be hollow or solid or foamed and the features may be of conductive, semi-conductive, or non-conductive materials.

Another objective is that the conduit tube may be helically wound, around a cable support-separator or internal to a communications cable, with variable winding patterns and of variable tensions and may be wrapped or jacketed.

Another objective of this invention is that the conduit tube may have corrugated or rifled inner surfaces and/or a corrugated or rifled outer surfaces for the installation of conductive media and the tubes may be comprised of metal or conductive or non-conductive polymer for electrical grounding or earthing media and wherein the tubes provide either an eccentric or concentric cable support-separator with a helically wound, variable pattern, and/or variably tensioned component and may be wrapped or jacketed.

Another objective of this invention is that the conduit tube may be conductive, semi-conductive, or non-conductive, filled and either solid or foamed or foamed with a solid skin layer, metal, conductive or non-conductive polymer media, providing electrical grounding or earthing, or primarily of organic or inorganic polymers or combinations of inorganic and organic polymer blends.

Another objective of this invention is that the conduit tube may be a combination of inorganic fillers or additives with inorganic and/or organic polymers or combinations including inorganic and organic polymer blends, homo and copolymers of ethylene, propylene, or polyvinyl chloride or fluorinated ethylene propylene, fluorinated ethylene, chlorinated ethylene propylene, fluorochloronated ethylene, perfluoroalkoxy, fluorochloronated propylene, a copolymer of tetrafluoroethylene and perfluoromethylvinylether (MFA), a copolymer of ethylene and chlorotrifluoroethelyene (ECTFE), as well as homo and copolymers of ethylene and/or propylene with fluorinated ethylene, polyvinylidene fluoride (PVDF), as well as blends of polyvinyl chloride, polyvinylidene chloride, nylons, polyesters, polyurethanes as well as unsubstituted and substituted fullerenes primarily comprised of $C_{60}$ molecules including nano-composites of clay and other inorganics such as ZnO, $TiO_2$, MgOH, and ATH (ammonium tetrahydrate), calcium molybdates, ammonium octyl molybdate and the like and may also be employed as nano-sized particles including tube shaped particles, wherein any and all combinations may be utilized to provide polymer blends, wherein the conduit tube comprises conductive media or nanotubes of $C_{60}$ in the form of fibers or substituted/unsubstituted fullerenes or fullerene compounds and like nano-composites or both and the conductive media or nanotubes of $C_{60}$ in the form of fibers or substituted/unsubstituted fullerenes or fullerene compounds and like nano-composites or both are imbedded the conduit tube.

Additionally an objective would be that the conduit may be comprised of combination metal oxides including magnesium trioxides, metal hydrates, including magnesium hydrates, silica or silicon oxides, brominated compounds, phosphated compounds, metal salts including magnesium hydroxides, ammonium octyl molybdate, calcium molybdate, or any and all effective combinations.

Another objective of this invention is that the conduit tube may also be comprised of compounds such as acid gas scavengers that scavenge gasses such as hydrogen chloride and hydrogen fluoride or other halogenated gasses occurring during combustion of the conduit tube.

Another objective of this invention is that the conduit tube may be comprised of organic and/or inorganic polymers that each may include the use of recycled or reground thermoplastics in an amount up to 100%.

Another objective of this invention is that the conduit tube is comprised of a polymer blend ratio of fluorinated or otherwise halogenated polymers or copolymers to ethylene or vinyl chloride polymers or copolymers of from 0.1% to up to 99.9% of fluorinated or otherwise halogenated polymers or copolymers to ethylene or vinyl chloride polymers or copolymers or foamed polymer blend including a nucleating agent of polytetrafluoroethylene, carbon black, color concentrate, or boron nitride, boron triflouride, direct injection of air or gas into an extruder, chloroflurocarbons (CFCs), or more environmentally acceptable alternatives such as pentane or other acceptable nucleating or blowing agents.

Another objective of this invention is that the conduit tube comprises solid, partially solid, or partially or fully foamed organic or inorganic dielectric materials, wherein the dielectric materials may include a solid skin surface with any one of a number of dielectric materials and wherein the conduit tube may include an adhesive surface.

Another alternative objective is a conduit tube comprising a sealant coated dimensionally heat-recoverable dual layer of the conduit tube comprising selecting a first polymer composition comprising a cross-linkable polymer, forming a second polymer composition by admixing a thermoplastic component and a rubber-like component in proportions such that a composition comprises 30 to 95% of the thermoplastic component and 5 to 70% of the rubber-like component with the second composition being convertible to a sealant composition.

Additionally an objective of the invention is deforming the conduit tube by extruding a first and second polymer composition to form a unitary dual layer possessing an outer tubular layer formed from the first crosslinkable polymer composition disposed concentrically around an inner tubular layer formed from the second convertible polymer composition and being in a first configuration at a temperature below the crystalline melt temperature of the first composition into the second configuration and exposing the conduit tube or jacketing to a source of energy to initiate formation of chemical bonds between adjacent polymer chains in the first composition, and inducing a chemical change in the second composition, thereby converting the second composition from a melt processable composition to a sealant composition and rendering the first composition recoverable in that the sealant composition is more easily recoverable as a first configuration upon subsequent heating.

Another objective of this invention is that the conduit tubes are capable of providing conductors that transmit data up to and greater than 10 Gbit/second while substantially mitigating or completely eliminating all forms of crosstalk, including alien crosstalk.

Another objective of the invention is that the non-conductive or conductive substrate such as metallized thermoplastic film would be at a nominal 50 ohms per square ($50\Omega/cm^2$) resistance and are attached, laminated, molded, extruded or co-extruded to the conduit tube and where the conduit tube surface itself may be comprised of imbedded non-conductive or conductive substrate such as metallized thermoplastic film at a nominal 50 ohms per square ($50\Omega/cm^2$) resistance, where the metallized thermoplastic film may include a drain wire of a preferred AWG or a braided shield in contact with the metallized film.

Another objective of the invention is where the conduit tube may be severed by a knife or other sharp tool in order to separate the conduit tube from a set of cable support-separator structures to ease in routing, installation and termination of selected conductive media and where the conductive media may also be pulled from the set of structures through a gap for easy separation of conductive media at an end of said cable.

Another objective of the invention is that the conduit tube surface provides for unshielded internal EME/RFI (electromagnetic emissions/radio frequency interference) external to a center of a high performance, multi-media cable and provides for a barrier from external EME/RFI, and wherein a ground wire may be placed in contact with the high performance, multi-media cable shielded surface(s) to provide additional EMI/RFI (electromagnetic interference/radio frequency interference) protection.

Another objective of the invention is a conduit tube comprised of polyolefin or other thermoplastic based polymers and blends thereof capable of meeting specific flammability and smoke generation requirements as defined by UL 910, NFPA 255, 259 or 262, and EN 50266-2-x, class B test specifications as well as NFPA 72 test criteria for circuit integrity, wherein said test criteria is met by either a rolled-up version or an initially flat state of said communications cable, cable support-separator, conduit tube or jacketing.

Included in the objective of this invention is a method for producing a conduit tube that comprises pulling of the conduit tube from a reel or cobb into a closing die to mate the conduit tube with other conductive or non-conductive media. The media is nested and shielding as necessary such that one or more twisted pair or other media are provided with single or double twist bunching which, may include a binder for holding a twisted bunch with optional shielding, or may include a single or two-step process potentially followed by use of an binder for holding the twisted bunch in place and may be jacketed via extrusion or wrapping or both with a final take up on a final take-up reel, wherein the method is provides a high performance, multi-media cable with at least one conduit tube.

Included in the objective of this invention is a method for wrapping or jacketing wherein binder wrapping may include one or more of several methods including single tape winding such as a cigarette tape wrap, spiral wrapping such as a notebook binder with a tighter or looser configuration or varying tensions or where the binder may simply comprise extruding a thin skin thermoplastic or a thicker skin thermoplastic or thermoset or the like over the high performance, multi-media cable assembly.

An additional method objective includes a binder that can be a corrosive and/or chemical resistant barrier thereby protecting the cable assembly and conductive or non-conductive media from severe environments.

SUMMARY OF THE INVENTION

Most preferentially this invention provides a conduit tube of varying inside and outside dimensions and wall thicknesses that are randomly or consistently varying so that when wrapped spirally or helically around or laid axially along a multi-media communications cable, with constant or varying tensions, the undulations of the above dimensions mitigate and eliminate alien crosstalk and/or EME/RFI interferences with the multi-media enjoined with the interior communications cable. The conduit tube may also be imbedded within a second or plurality of conductive media and wrapped within or laid longitudinally among the conductive pairs to form an eccentric cable.

The use of the conduit tube may use the features of a multi-media cable support-separator, to provide an eccentric cable support-separator also useful in mitigating alien crosstalk and/or EME/RFI interferences. The conduit tube may be formed exhibiting any cross sectional shape such as rectangular, square, rectangular, elliptical or in any feasible geometric shape.

Eccentricity of the hollow spaces in the cable support-separators can be set apart per cable manufacturers specifications so that individual or sets of pairs can be spaced closer or farther from one another, allowing for better power sum values of equal level far end and near end cross talk. This "offsetting" between conductor pairs in a logical, methodological pattern to optimize electrical properties is an additional benefit associated with the cable support-separators of this invention.

The conduit tube may be comprised of a metallic or conductive or non-conductive polymer and may potentially be used as an electrical drain wire. It may be solid, foamed, foamed with a solid skin, and composed of a blend of non-halogenated as well as halogenated polymers that also include inorganic fillers as described above. Additionally the conduit tube may be filled with fibers or wire pairs of conductive, semi-conductive or non-conductive materials.

Accordingly, the present invention provides a conduit tube that meets the exacting specifications of high performance data cables and/or fiber optics or the possibility of both transmission media in one cable that has a superior resistance to deformation during manufacturing and use, allowing for control of near-end cross-talk, electrical instability due to shielding, and is capable of 200 and 1 Ghz (Categories 6 and 7 and beyond) transmission with a positive attenuation to cross-talk ratio (ACR ratio) of typically 3 to 10 dB.

Additionally, it has been known that a conductor pair may actually have physical or chemical bonds that allow for the pair to remain intimately bound along the length of the cavity in which they lie. U.S. Pat. No. 6,639,152, herein incorporated by reference, describes a means by which the conductor pair is adhered to or forced along the cavity walls by the use of grooves. This again increases the distance, thereby increasing the volume of air or other dielectrically superior medium between conductors in separate cavities. As discussed above, spacing between pairs, spacing away from jackets, and balanced spacing all have an effect on final electrical cable performance.

It is an object of the present invention to provide a conduit tube that has a specially designed interior that accommodates conductors with a variety of AWG'S, impedances, improved crush resistance, controlled near end cross talk (NEXT), controlled electrical instability due to shielding, increased breaking strength, and allows the conductors, such as twisted pairs, to be wound in a manner to achieve positive ACR ratios using non-conventional composite compound blends that include halogenated and non-halogenated polymers together with optional inorganic and organic additives that include inorganic salts, metallic oxides, silica and silicon oxides as well as any number of substitute and unsubstituted fullerenes in all forms including nanotubes.

It is still another object of the invention to provide a conduit tube that does not require individual shielding and that allows for the precise spacing of media such as twisted pairs and/or fiber optics with relative ease. In the present invention, the conduit tube may include individual glass fibers as well as conventional metal conductors as the transmission medium that would be either together or separated.

Another embodiment of the invention includes the use of a foamed conduit tube which in both significantly reduces the material required along the length of the finished cable. The effect of foaming and/or producing a conduit tube should result in improved flammability of the overall cable by reducing the amount of material available as fuel for the UL 910 test, improved electrical properties for the individual non-optical conductors, and reduction of weight of the overall cable.

Yet another embodiment provided in U.S. Pat. No. 6,639,152 that is included in the present invention allows for interior corrugated or rifled clearance channels provided by the shaped sections of the hollow tube. This corrugated internal section has internal axial grooves that allow for separation of conductor pairs from each other or even separation of single conductors from each other as well as separation of optical conductors from conventional metal conductors. Alternatively, external grooves may allow for further separation thus providing a method for spacing conductor pairs or fibers with respect to the cable support-separator or adjacent cabling with minimal additional material in order to reduce the amount of available combustible material.

The flexibility of the conduit tube also allows for ease of customization by cable manufacturers in and around a communications cable of up to forty-eight pairs of conductive media and accommodation of an overall external shield. Additionally a wrap or jacket may be applied outside of the conduit tube.

Alternatively, depending on manufacturing capabilities, the use of a tape or polymeric binding sheet may be necessary in lieu of extruded thermoplastic jacketing. Taping or other means may provide special properties of the cable construction such as reduced halogen content or cost of such a construction.

Yet another related embodiment includes the use of a strength member running parallel in the longitudinal direction within the conduit tube along the length of the communications cable.

In a related embodiment, the strength member could be the conduit tube itself, or in an additional related embodiment, the strength member could be inserted in the conduit tube.

It is possible to leave the conduit tube empty in that the conduit tube cavity itself or within a jacket would be pulled into place and left for future "blown fiber" or other conductors along the length using compressed air or similar techniques such as use of a pulling tape or the like.

Most preferentially this invention provides a solid configuration of varying outside diameters that are randomly or consistently varying so that when wrapped spirally or helically around or laid axially along a multi-media communications cable, with constant or varying tensions, the undulations of the above variations mitigate and eliminate alien cross-talk and/or EME/RFI interferences with the multi-media enjoined with the interior communications cable. The solid configuration may also be imbedded within a second or subsequent conductive pairs and wrapped within or laid longitudinally among the conductive pairs to form an eccentric cable.

An alternative embodiment would be a solid structure in the same shape or configuration previously describing the hollow tube format. The solid configuration may be comprised of a metallic or conductive or non-conductive polymer and may potentially be used as an electrical drain wire. The use of the solid configuration may use the features of a multi-media cable support-separator, to provide an eccentric cable support-separator also useful in mitigating alien cross-talk and/or EME/RFI interferences.

The solid configuration may be formed exhibiting any cross sectional shape such as rectangular, square, diamond, round, ovoid or corrugated.

The flexibility of the solid configuration also allows for ease of customization by cable manufacturers and accommodation of an overall external shield. Additionally a wrap or jacket may be applied outside of the solid configuration.

The solid configuration may be comprised of a metallic or conductive or non-conductive polymer and may potentially be used as an electrical drain wire. It may be solid, foamed, foamed with a solid skin, and composed of a blend of non-halogenated as well as halogenated polymers that also include inorganic and organic additives that include inorganic salts, metallic oxides, silica and silicon oxides as well as any number of substitute and unsubstituted fullerenes in all forms including nanotubes as described above.

Accordingly, the present invention provides a solid configuration that meets the exacting specifications of high performance data cables and/or fiber optics or the possibility of both transmission media in one cable that has a superior resistance to deformation during manufacturing and use, allowing for control of near-end cross-talk, electrical instability due to shielding, and is capable of 200 and 1 Ghz (Categories 6 and 7 and beyond) transmission with a positive attenuation to cross-talk ratio (ACR ratio) of typically 3 to 10 dB.

In yet another embodiment, external grooves may allow for further separation thus providing a method for spacing conductor pairs or fibers with respect to the cable support-separator or adjacent cabling with minimal additional material in order to reduce the amount of material available as fuel.

Alternatively, depending on manufacturing capabilities, the use of a tape or polymeric binding sheet may be necessary in lieu of extruded thermoplastic jacketing. Taping or other means may provide special properties of the cable construction such as reduced halogen content or cost of such a construction.

It is to be understood that each of the embodiments above could include a flame-retarded, smoke suppressant version, and that each could include the use of recycled or reground thermoplastics in an amount up to 100%.

Other desired embodiments, results, and novel features of the present invention will become more apparent from the following drawings and detailed description and the accompanying claims.

DETAILED DESCRIPTION OF THE DRAWINGS

The following description will further help to explain the inventive features of the hollow tube and a solid configuration.

Figure 1A:
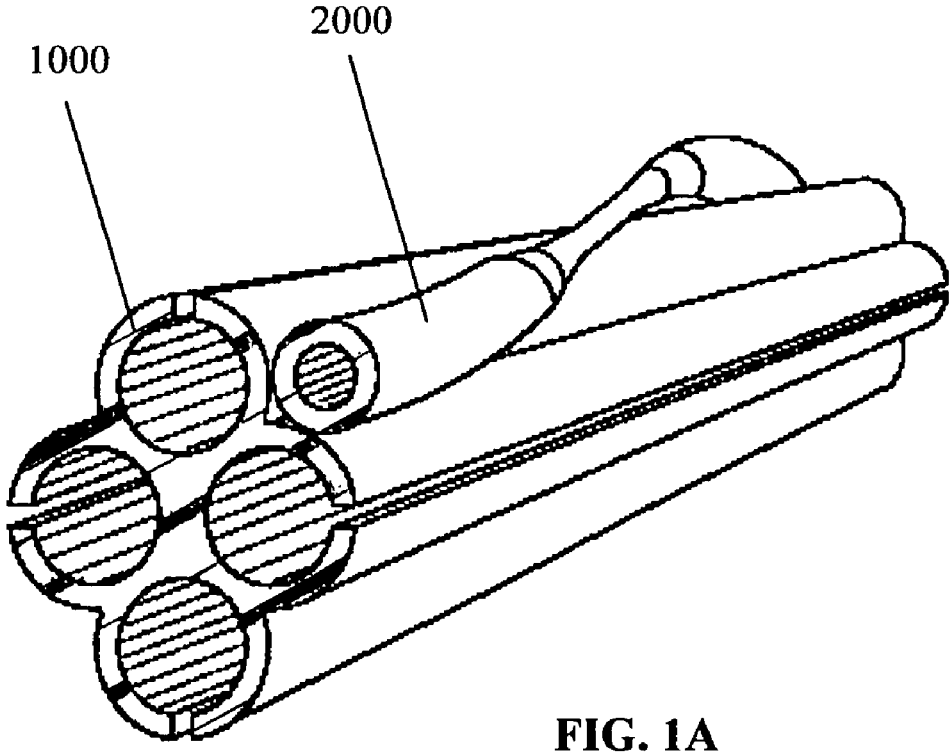
FIG. 1A is a three dimensional view of a variable diameter conduit tube that may be wound around a cable support separator and conductive media bundle for the purpose of varying the cable diameter by functionally spacing the cable at varying distances from the adjacent conductors and cables.
Figure 1B:
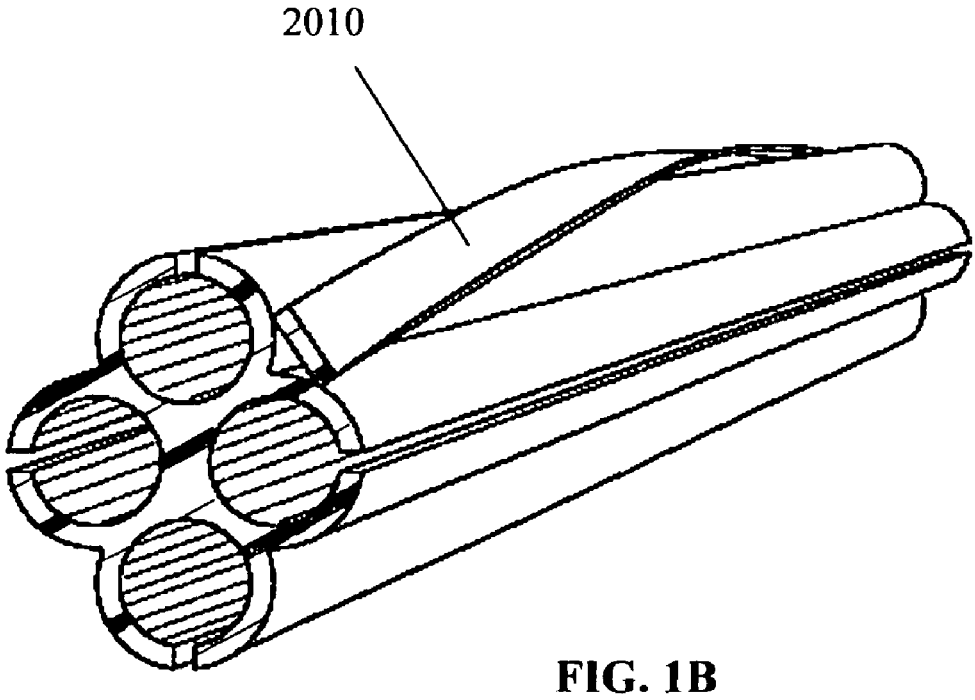
FIG. 1B is a three dimensional view of a solid configuration wrapped around a cable-support-separator which allows for changes in conductor spacing therefore providing the ability to reduce attenuation and crosstalk between adjacent conductors and cables.

FIGS. 1A and 1B are three dimensional views of a variable diameter conduit tube [2000] or variable solid configuration [2010] of various shapes that are random in diameter and dimensions along a longitudinal plane that may be hollow or solid and may be constructed of conductive, semi-conductive, or non-conductive materials for the purpose of varying the overall cable dimensions by consistently randomly spacing the cable at varying distances from the adjacent media, thereby reducing the possibility of cross talk. The conduit tubes may be comprised of a metallic or conductive or non-conductive polymer and may potentially be used as an electrical drain wire. The use of the conduit tubes as shown may use the features of a cable support-separator, to provide an eccentric cable support-separator [1000]. When used outwardly, the variable diameter conduit tube [2000] may contain bundles of conductive media or be a variable solid configuration [2010] and may be spirally or helically wound consistently or inconsistently with variable patterns and of consistently or inconsistently variable tensions to mitigate variations in adjacent cabling EME/RFI (electromagnetic emissions/radio frequency interference) emissions in the conductive media.

Additional optional conduit tubes may exist within or exterior to the central region, extend along the longitudinal length of the support members and where the conduit tubes may be hollow or solid or foamed or any multi-layered extruded material combination thereof. Additionally a wrap or jacket may be applied outside of the conduit tube [2000] or variable solid configuration [2010].

It will, of course, be appreciated that the embodiments which have just been described have been given simply by the way of illustration, and the invention is not limited to the precise embodiments described herein; various changes and modifications may be effected by one skilled in the art without departing from the scope or spirit of the invention as defined in the appended claims.

What is claimed is:

1. A high performance, multi-media communications cable comprising;

one or more cable support-separators and one or more metallic or fiber optic conductive media conductors or both, wherein one or more conduit tube(s) may exist within or exterior to said high performance, multi-media communications cable or said cable support-separators extending along a longitudinal length of said high performance, multi-media communications cable and wherein said conduit tube(s) provide said high performance, multi-media communications cable with eccentric or concentric shape;

said conduit tube(s) each comprising varying outside diameters that are randomly or consistently varying along said longitudinal length of each said conduit tube wherein the various shapes, material thicknesses, diameters and sizes are provided around a constant centerline of each inner conduit, said conduit tube(s) extend along said longitudinal length of said high performance, multi-media communications cable or said cable support-separators, thereby varying overall cable diameters and wherein said conduit tube(s) lay longitudinally along or are helically wound around said high performance, multi-media communications cable or said cable support-separators internal to said high performance, multi-media communications cable wherein said conduit tube(s) comprise variable winding patterns with variable tensions and wherein said conduit tube(s) provide said high performance, multi-media communications cable with improved electrical performance, optical performance and/or reduced crosstalk.

2. The high performance, multi-media communications cable of claim 1, wherein said conduit tube(s), each or separately, comprise said constant centerline within said inner conduit having a variable radial and axial diameter along said length of each conduit tube provided by varying said inner conduit diameter and holding the material thickness constant or by varying said material thickness around a constant diameter of said inner conduit.

3. The high performance, multi-media communications cable of claim 1, wherein said conduit tube(s) may be filled and either solid or foamed or foamed with a solid skin layer.

4. The high performance, multi-media communications cable of claim 1, wherein said conduit tube(s) exist within a plurality of twisted pairs of conductive media or exterior to said plurality of twisted pairs of conductive media and wherein said plurality of twisted pairs is at least 1 twisted pair.

5. The high performance, multi-media communications cable of claim 1, wherein said conduit tube(s) exist within a plurality of twisted pairs of conductive media or exterior to said plurality of twisted pairs of conductive media and wherein said plurality of twisted pairs is 4 to 24 twisted pair.

6. The high performance, multi-media communications cable of claim 1, wherein said conduit tube(s) include variable winding patterns and variable tensions within or external to said high performance, multi-media communications cable thereby varying said high performance, multi-media communications cable overall diameter and thereby also varying the conductive nature of said high performance, multi-media communications cable and wherein said conduit tube(s) may be wrapped around an exterior portion of said high performance, multi-media communications_cable or jacketed within an internal portion of said high performance, multi-media communications cable.

7. The high performance, multi-media communications cable of claim 1, wherein said conduit tube(s) may be comprised of conductive, semi-conductive, or non-conductive materials.

8. The high performance, multi-media communications cable of claim 1, wherein said conduit tube(s) may have corrugated or rifled inner surfaces and/or corrugated or rifled outer surfaces and wherein installation of conductive media may be accomplished.

9. The high performance, multi-media communications cable of claim 1, wherein said conduit tube(s) may be comprised of metal or conductive or non-conductive polymer, and wherein said conduit tube(s) may be utilized for electrical grounding or earthing media.

10. The high performance, multi-media communications cable of claim 1, wherein said conduit tube(s) provide either an eccentric or concentric high performance, multi-media communications cable by providing a helically wound, variable pattern, and/or variably tensioned component wherein said conduit tube(s) may be wrapped around an exterior portion of said high performance, multi-media communications cable or jacketed within an internal portion of said high performance, multi-media communications cable.

11. The high performance, multi-media communications cable of claim 1, wherein said conduit tube(s) may be conductive, semi-conductive, or non-conductive, filled and either solid or foamed with a solid skin layer, metallic, conductive or non-conductive polymer media, providing electrical grounding or earthing, or wherein said conduit tube(s) may be primarily comprised of organic or inorganic polymers or combinations of inorganic and organic polymer blends.

12. The high performance, multi-media communications cable of claim 1, wherein said conduit tube(s) may be a combination of inorganic fillers or additives with inorganic and/or organic polymers or combinations including inorganic and organic polymer blends, homo and copolymers of ethylene, propylene, or polyvinyl chlorine or fluorinated ethylene propylene, fluorinated ethylene, chlorinated ethylene propylene, fluorochlorinated ethylene, perfluoroalkoxy, fluorochlorinated propylene, a copolymer of tetrafluoroethylene and perfluoromethylvinylether (MFA), a copolymer of ethylene and chlorotrifluoroethelyene (ECTFE), as well as homo and copolymers of ethylene and/or propylene with fluorinated ethylene, polyvinylidine fluoride (PVFD), as well as blends of polyvinyl chloride, polyvinylidine chloride, nylons, polyesters, polyurethanes as well as unsubstituted and substituted fullerenes primarily comprised of $C_{60}$ molecules including nano-composites of clay and other organics such as ZnO, $TiO_2$, MgOH, and ATH (ammonium tetrahydrate), calcium molybdates, ammonium octyl molybdate, and wherein and nano-composites or other inorganics may be employed as nano-sized particles including tube shaped particles, wherein any and all combinations may be utilized to provide polymer blends for manufacture of said conduit tube(s), and wherein said conduit tube(s) may provide housing for said conductive media or nanotubes of $C_{60}$ in the form of fibers or substituted/unsubstituted fullerenes or fullerene compounds including nano-composites in the form of fibers or substituted/unsubstituted fullerenes compounds wherein said nano-composites may also be imbedded within said conduit tube(s).

13. The high performance, multi-media communications cable of claim 1, wherein said conduit tube(s) may be comprised of a combination of metal oxides including magnesium trioxides, metal hydrates, including magnesium hydrates, silica or silica oxides, brominated compounds, phosphated compounds, metal salts including magnesium hydroxides, ammonium octyl molybdate, or any and all effective combinations of said oxides, hydrates, silicas, compounds, salts, hydroxides, or molybdate.

14. The high performance, multi-media communications cable of claim 1, wherein said conduit tube(s) may also be comprised of compounds that include acid gas scavengers that scavenge gasses such as hydrogen chloride and hydrogen fluoride or other halogenated gasses occurring during combustion of said conduit tube(s).

15. The high performance, multi-media communications cable of claim 1, wherein said conduit tube(s) may be comprised of organic and/or inorganic polymers that each may include the use of recycled or reground thermoplastics in an amount up to 100%.

16. The high performance, multi-media communications cable of claim 1, wherein said conduit tube(s) are comprised of a polymer blend ratio of fluorinated or otherwise halogenated polymers or copolymers to ethylene or vinyl chloride polymers or copolymers of from 0.1% to up to 99.9% of fluorinated or otherwise halogenated polymers or copolymers to ethylene or vinyl chloride polymers or copolymers or foamed polymer blends including a nucleating agent of polytetrafluoroethylene, carbon black, color concentrate, or boron nitride, boron trifluoride, direct injection of air or gas into an extruder, chlorofluorocarbons (CFCs), or more environmentally acceptable alternatives such as pentane or other acceptable nucleating or blowing agents.

17. The high performance, multi-media communications cable of claim 1, wherein said conduit tube(s) comprise solid, partially solid, or partially or fully foamed organic or inorganic dielectric materials, wherein said dielectric materials may include a solid skin surface with any one of a number of said dielectric materials and wherein said conduit tube(s) may include an adhesive surface.

18. The high performance, multi-media communications cable of claim 1, wherein said conduit tube(s) comprise a sealant coated dimensionally heat-recoverable dual layer of said conduit tube(s) comprising selecting a first polymer composition comprising a cross-linkable polymer, forming a second polymer composition by admixing a thermoplastic component and a rubber-like component in proportions such that a composition comprises 30 to 95% of said thermoplastic component and 5 to 70% of said rubber-like component with said second composition being convertible to a sealant composition.

19. The high performance, multi-media communications cable of claim 1, wherein said conduit tube(s) potentially deforming said conduit tube(s) by extruding a first and second polymer composition to form a unitary dual layer, wherein said second polymer composition forms an outer tubular layer formed from a crosslinkable polymer composition disposed concentrically around an inner tubular layer and being in a first configuration at a temperature below the crystalline melt temperature of said first polymer composition whereby exposing said conduit tube(s) or said jacketing to a source of energy initiates formation of chemical bonds between adjacent polymer chains in said first composition, and induces a chemical change in said second composition, thereby converting said second composition from a melt processable composition to a sealant composition and rendering said first composition recoverable in that said sealant composition is more easily recoverable upon subsequent heating.

20. The high performance, multi-media communications cable of claim 1, wherein said conduit tube(s) are capable of providing conductors that transmit data up to and greater than 10 Gbit/second while substantially mitigating or completely eliminating all forms of crosstalk, including alien crosstalk.

21. The high performance, multi-media communications cable of claim 1, wherein said conduit tube(s) comprise said non-conductive or conductive substrate such as metallized thermoplastic film that is at a nominal 50 ohms per square ($50\Omega/cm^2$) resistance and is attached, laminated, molded, extruded or co-extruded to said conduit tube(s) and wherein surfaces of said conduit tube(s) themselves may be comprised of imbedded non-conductive or conductive substrate such as said metallized thermoplastic film at a nominal 50 ohms per square ($50\Omega/cm^2$) resistance, where said metallized thermoplastic film may include a drain wire of a preferred AWG or a braided shield in contact with said metallized film.

22. The high performance, multi-media communications cable of claim 21, wherein said conduit tube(s) surfaces provides shielded or unshielded internal EME/RFI (electromagnetic emissions/radio frequency interference) barrier surfaces external to said high performance, multi-media communications cable and also provide for a barrier from external EME/RFI, and wherein said drain wire may be placed in contact with said shielded surfaces to provide additional EME/RFI (electromagnetic emissions/radio frequency interference) protection.

23. The high performance, multi-media communications cable of claim 1, wherein said conduit tube(s) may be severed by a knife or other sharp tool in order to separate said conduit tube(s) from a set of said cable support-separator structures to ease in routing, installation and termination of said conductive media.

24. The high performance, multi-media communications cable of claim 1, wherein said conduit tube(s) are comprised of polyolefin or other thermoplastic based polymers and blends thereof capable of meeting specific flammability and smoke generation requirements as defined by UL 910, NFPA 255, 259, 262 and EN 50266-2-x, class B test specifications as well as NFPA 72 test criteria for circuit integrity, wherein said test criteria is met by each of said high performance, multi-media communications cable, said cable support-separators, said conduit tube(s) and/or said jacketing.

25. A method for creating a high performance, multi-media communications cable with one or more cable support and one or more metallic or fiber optic conductive media conductors or both, wherein one of more_conduit tube(s) may exist within or exterior to said high performance, multi-media communications cable or said cable support-separators extending along a longitudinal length of said high performance, multi-media communications cable and wherein said conduit tube(s) provide said high performance, multi-media communications cable with eccentric or concentric shape;

said conduit tube(s) each comprising varying outside diameters that are randomly or consistently varying along said longitudinal length of each said conduit tube wherein the various shapes, material thicknesses, diameters and sizes are provided around a constant centerline of each inner conduit, said conduit tube(s) extend along said longitudinal length of said high performance, multi-media communications cable or said cable support-separators, thereby varying overall cable diameters and wherein said conduit tube(s) lay longitudinally along or are helically wound around said high performance, multi-media communications cable or said cable support-separators internal to said high performance, multi-media communications cable wherein said conduit tube(s) comprise variable winding patterns with variable tensions and wherein said conduit tube(s) provide said high performance, multi-media communications cable with improved electrical performance, optical performance and/or reduced crosstalk.

26. The method for creating a high performance, multi-media communications cable as in claim 25, wherein pulling of said conduit tube(s) from a reel or a cob into a closing die to mate said conduit tube(s) with other conductive or non-conductive media providing nesting and shielding as necessary such that one or more twisted pair or other media are provided with single or double twist bunching which, may include a binder for holding said twisted bunching with shielding, or may include a single or two step process potentially followed by use of a binder for holding said twisted bunching in place and wherein said cable may be jacketed via extrusion or wrapping or both with the final take up on a final take-up reel, wherein once completed, said method included providing said high performance, multi-media cable with said conduit tube(s).

27. The method for creating a high performance, multi-media communications cable as in claim 25, wherein said conduit tube(s) are contained within a wrapping or jacketing of said high performance, multi-media communications cable and wherein said binder and said wrapping may include one or more of several methods including single tape winding such as a cigarette tape wrap, spiral wrapping such as a notebook binder with a tighter or looser configuration or varying tensions or wherein said binder may simply comprise extruding a thin skin thermoplastic or thermoset or the like over an entire high performance, multi-media communications cable assembly.

* * * * *